US010058163B2

(12) United States Patent
Mather et al.

(10) Patent No.: US 10,058,163 B2
(45) Date of Patent: Aug. 28, 2018

(54) ADJUSTABLE BACKPACK

(71) Applicant: Thule Inc., Seymour, CT (US)

(72) Inventors: Ryan Mather, Boulder, CO (US); Rebecca Taylor, Longmont, CO (US)

(73) Assignee: Thule, Inc., Seymour, CT (US)

( * ) Notice: Subject to any disclaimer, the term of this patent is extended or adjusted under 35 U.S.C. 154(b) by 0 days.

(21) Appl. No.: 15/281,794

(22) Filed: Sep. 30, 2016

(65) Prior Publication Data

US 2017/0099932 A1 Apr. 13, 2017

Related U.S. Application Data

(60) Provisional application No. 62/239,577, filed on Oct. 9, 2015.

(51) Int. Cl.
*A45F 3/04* (2006.01)
*A45F 3/12* (2006.01)

(52) U.S. Cl.
CPC ..... *A45F 3/047* (2013.01); *A45F 2003/122* (2013.01); *A45F 2003/125* (2013.01); *A45F 2003/127* (2013.01)

(58) Field of Classification Search
CPC ..... A45F 2003/122; A45F 2003/125; A45F 2003/127; A45F 3/04; A45F 3/047; A45F 3/06; A45F 3/08; A45F 3/10
USPC ..... 224/627, 631–632
See application file for complete search history.

(56) References Cited

U.S. PATENT DOCUMENTS 5,598,831 A * 2/1997 Izuta ..... F41B 5/14 124/90
7,028,873 B1 * 4/2006 Collier ..... A45F 3/08 224/628
9,119,459 B2 * 9/2015 Kim ..... A45F 3/08
2005/0092802 A1 * 5/2005 Maley ..... A45F 3/08 224/628
2005/0279797 A1 * 12/2005 Martin ..... A44B 11/065 224/637
2009/0212081 A1 * 8/2009 Liang ..... A45F 3/04 224/148.2
2011/0214212 A1 * 9/2011 Marx ..... A41D 13/0007 2/2.5

* cited by examiner

*Primary Examiner* — Scott McNurlen
(74) *Attorney, Agent, or Firm* — Sterne, Kessler, Goldstein & Fox P.L.L.C.

(57) ABSTRACT

A bag, such as a backpack, includes a back panel having an edge portion, a spacing panel having a fixed edge attached to the back panel and a free edge, an adjustment device, and a lace connecting the adjustment device and the spacing panel. The adjustment device can be configured to retract the lace, thereby translating the spacing panel toward the edge portion of the back panel, thereby increasing a space between the spacing panel and the back panel. The space between the spacing panel and the back panel can be smaller in a first configuration than in a second configuration and the back panel of the bag can be curved in the second configuration.

25 Claims, 12 Drawing Sheets

ADJUSTABLE BACKPACK

BACKGROUND

Field

Embodiments of the present invention relate to adjustable bags. More specifically, embodiments of the present invention relate to bags and backpacks that can be adjusted to form a curve in a back panel of the bag, thereby increasing or decreasing a space between the bag and the carrier's back.

Background

Bags, such as backpacks, are useful for storing and carrying equipment. Some backpacks are used for outdoor sports such as hiking. Sometimes it is desirable to have a backpack that is flat against the carrier's back, for example, when carrying a laptop inside the backpack. Other times it is desirable to have the backpack form a curve to provide airflow around the carrier's back during activities such as hiking. In the latter case, in order to improve the comfort of the backpack it is desirable to have a space between the carrier's back and the back panel of the backpack. This can allow for air to flow between the bag and the carrier's back, thereby cooling the carrier. However, presently backpacks are not easily adjusted to form such a curve and create such a space and must be removed from the carrier's back in order to adjust the backpack.

BRIEF SUMMARY

In certain embodiments, a bag includes a back panel having an edge portion, a spacing panel having a fixed edge attached to the back panel and a free edge, an adjustment device, and a lace connecting the adjustment device and the spacing panel. The adjustment device can be configured to retract the lace, thereby translating the spacing panel toward the edge portion of the back panel, thereby increasing a space between the spacing panel and the back panel. In certain embodiments, the space between the spacing panel and the back panel is smaller in a first configuration than in a second configuration. The back panel of the bag can be curved in the second configuration. In certain embodiments, the spacing panel can be attached to the back panel at a lower edge of the back panel. In certain embodiments, a lower edge of the spacing panel can be attached to the lower edge of the back panel.

In certain embodiments, the spacing panel can include a mesh portion. In certain embodiments, the spacing panel can include a reinforcement member disposed across a width of an upper portion of the spacing panel. In certain embodiments, a substantially rigid frame can be coupled with the back panel. In certain embodiments, the frame can be configured to flex in a curved manner as the bag transitions from the first configuration to the second configuration.

In certain embodiments, the spacing panel can include a first lace support. The lace can extend through the first lace support. In certain embodiments, the back panel can have a second lace support and the spacing panel can have a third lace support. In certain embodiments, the lace can extend through, in order, the first lace support and the second lace support. In certain embodiments, the second lace support can be disposed at the edge portion of the back panel, and the first and third lace supports can be disposed along an edge of the spacing panel.

In certain embodiments, the adjustment device can be configured to move the first lace support closer to the second lace support. In certain embodiments, the lace can be ultra-high-molecular-weight polyethylene. In certain embodiments, the lace can be a steel cord. In certain embodiments, at least one tube can surround a portion of the lace.

The bag can include one or more shoulder straps. In certain embodiments, the lace can pass through an exterior side of the shoulder strap and an interior side of the shoulder strap. In certain embodiments, the lace can pass through a hole in the interior side of the shoulder strap. In certain embodiments, a reinforcement ring can be disposed around a circumference of the hole. In certain embodiments, the shoulder strap can include a guide component having a passage through which the lace can pass. In certain embodiments, the shoulder strap can include a reinforcement panel having a cutout through which the lace can pass. The reinforcement panel can be configured to resist twisting of the shoulder strap.

In certain embodiments, the adjustment device can be an adjustment dial. In certain embodiments, rotation of the adjustment dial can tighten the lace, thereby translating the spacing panel. In certain embodiments, the adjustment device can be disposed on the shoulder strap of the bag. In certain embodiments, the adjustment device can be disposed on the back panel of the bag. In certain embodiments, the adjustment device can be disposed on the spacing panel of the bag.

In certain embodiments, a backpack can include an adjustment dial disposed on the backpack, a lace extending from the adjustment dial, a back panel having an upper portion with an upper edge and a lower portion having a lower edge, and a spacing panel having an upper portion with an upper edge, a lower portion having a lower edge, and a first lace support. In certain embodiments, the lower portion of the spacing panel can be attached to the lower portion of the back panel. In certain embodiments, a space between the spacing panel and the back panel can be smaller in a first configuration than in a second configuration. In certain embodiments, the back panel of the bag can be curved in the second configuration.

In certain embodiments, the lace can extend through the first lace support. In certain embodiments, the back panel can have a second lace support and the lace can extend through, in order, the first lace support and the second lace support. In certain embodiments, the second lace support can be disposed at the upper edge of the back panel, and the first lace support can be disposed along an edge of the spacing panel.

In certain embodiments, the lace can pass through an exterior side of a shoulder strap and an interior side of the shoulder strap. In certain embodiments, the lace can pass through a hole in the interior side of the shoulder strap, and a reinforcement ring can be disposed around a circumference of the hole. In certain embodiments, the shoulder strap can have a reinforcement panel with a cutout through which the lace can pass. The reinforcement panel can be configured to resist twisting of the shoulder strap. In certain embodiments, rotation of the adjustment dial can retract the lace. Retracting the lace can move the first lace support toward the second lace support such that a space between the spacing panel and the back panel is smaller in a first configuration than in a second configuration, and wherein the back panel of the bag is curved in the second configuration.

A method of adjusting the fit of a backpack can include rotating an adjustment dial. Rotating the adjustment dial can tighten a lace extending from the adjustment dial, which can increase an airflow space between a spacing panel connected to the lace and a back panel of the backpack. In certain embodiments, tightening the lace can translate the spacing panel and curve the back panel of the backpack. In certain embodiments, the adjustment dial can be rotated while the backpack is carried on a back of a user by at least one shoulder strap.

In certain embodiments, the method can include pulling the adjustment dial, which can release a portion of the lace from the adjustment dial. This can decrease the airflow space between the spacing panel and the back panel.

An adjustment system for a backpack can include an adjustment dial, a lace extending from the adjustment dial, and a spacing panel having at least one lace support. In certain embodiments, the lace can extend through the lace support to couple the spacing panel with the adjustment dial. The adjustment system can be configured to adjust a space between the spacing panel and a back panel of the backpack by forming a curve in the back panel of the backpack.

In certain embodiments, a first end and a second end of the lace can be connected to the adjustment dial. In certain embodiments, rotation of the adjustment dial can retract the lace about the adjustment dial. In certain embodiments, the spacing panel can include a first and second lace support and the adjustment system can include a third lace support disposed on the back panel of the backpack. In certain embodiments, the lace can pass through, in order, the first lace support, the second lace support, and the third lace support.

BRIEF DESCRIPTION OF THE DRAWINGS/FIGURES

The accompanying drawings which are incorporated herein and form part of the specification, illustrate the embodiments and, together with the description, further serve to explain the principles of the embodiments and to enable a person skilled in the relevant art(s) to make and use the embodiments.

Figure 1:
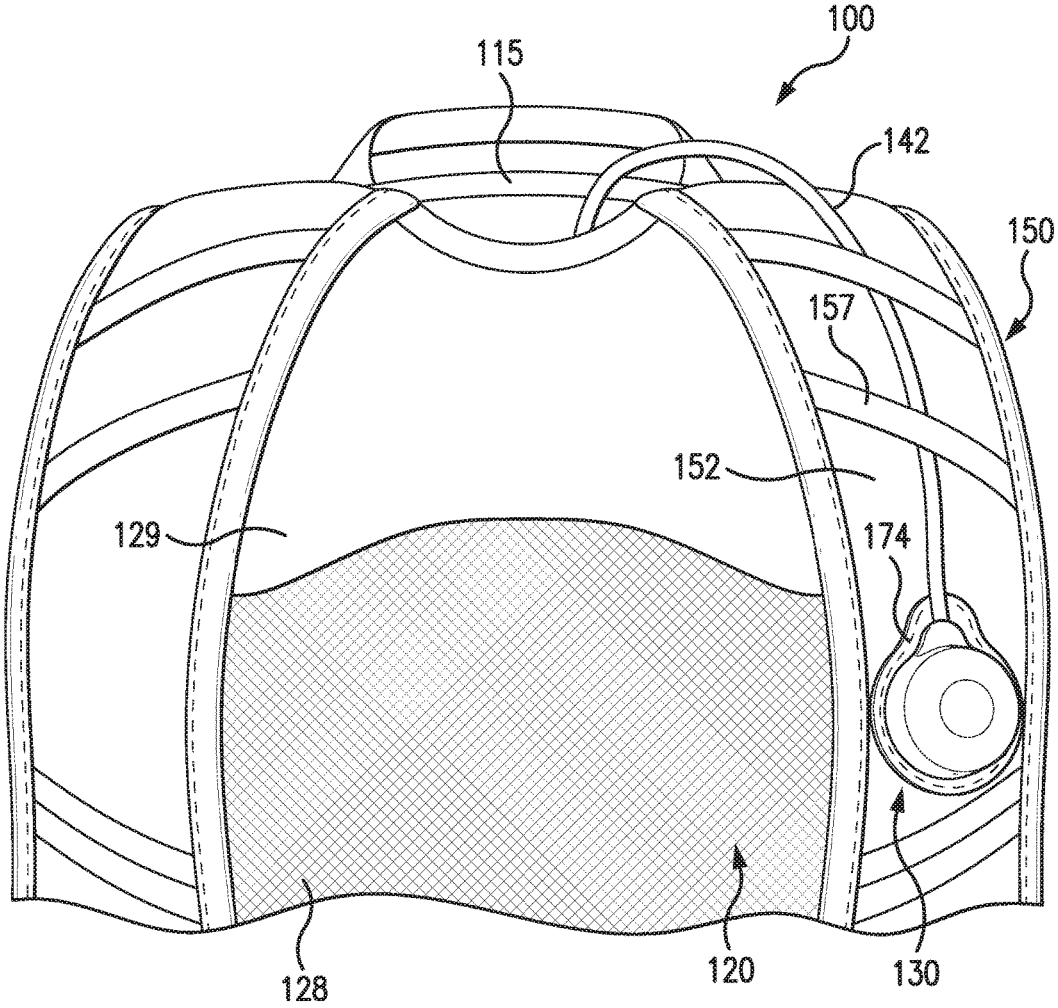
FIG. 1 is a partial rear view of a bag according to an embodiment.

The features and advantages of the embodiments will become more apparent from the detailed description set forth below when taken in conjunction with the drawings, in which like reference characters identify corresponding elements throughout. In the drawings, like reference numbers generally indicate identical, functionally similar, and/or structurally similar elements.

DETAILED DESCRIPTION

The present invention will now be described in detail with reference to embodiments thereof as illustrated in the accompanying drawings. References to "one embodiment," "an embodiment," "some embodiments," "certain embodiments," etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

Many bags and backpacks are used for outdoor activities, for example, hiking or camping. Other bags are used to transport goods, for example, books, laptops, or other portable electronic devices. Carrying a bag, particularly in warm weather, can be uncomfortable for the carrier. Heat and perspiration can get trapped between the carrier's back and the back panel of the bag. The bag can also rub against the carrier's back, causing abrasions or discomfort. The bags and backpacks disclosed herein may provide significant benefits to the carrier. For example, an adjustable spacing panel can facilitate increasing a space between the carrier's back and the back panel of the bag. The adjustment system can form a curve in the back panel, thereby increasing the space between the carrier's back and the back panel of the bag. This can allow air to flow in the space between the carrier's back and the back panel of the bag, thereby cooling the carrier.

Furthermore, these benefits can be achieved while the carrier is carrying the bag. For example, by locating the adjustment device on an accessible portion of the bag, such as a shoulder strap of the bag, the carrier can adjust the spacing between the carrier's back and the back panel of the bag without the hassle of removing the bag from their back. Much or all of the adjustment system, for example the lace, can be concealed, for example, within part of the shoulder strap or behind padding, so that it is hidden from view. The adjustment device can also be hidden from view, for example, by placing it near a lower edge of the back panel or spacing panel.

FIGS. 1-4 illustrate embodiments and elements of bag 100. As shown in FIG. 1, bag 100 can include shoulder strap 150 and spacing panel 120. Spacing panel 120 can have mesh portion 128 and one or more sections of padding 129. Bag 100 can include adjustment device 130. In certain embodiments, adjustment device 130 can be attached to shoulder strap 150. A lace 140 (see, e.g., FIG. 8), which in certain embodiments can be surrounded by tubing 142, can extend from adjustment device 130. In certain embodiments, one or more straps 157 can hold lace 140 and tubing 142 against shoulder strap 150 to prevent them from snagging on objects.

Because lace 140 is shown in many embodiments as housed within tubing 142, the term "lace" may be used when both lace 140 and tubing 142 are shown in the Figures. Furthermore, the term "lace" refers to any type of wire, cord, string, cable, rope, filament, strap, tether, belt, etc. Lace 140 can be made from any suitable material, for example, but not limited to, polymers, metal, fabrics (natural and/or synthetic), and ultra-high-molecular-weight polyethylene fiber (e.g., Dyneema) that exhibit sufficient axial strength and bendability for the present application. In certain embodiments, lace 140 can have a coating, such as PTFE, nylon, or Teflon, to reduce friction. In certain embodiments, lace 140 can be woven, braided, or twisted. In certain embodiments, lace 140 can be made from steel (including stainless steel). The diameter and/or load strength of lace 140 can be adjusted depending on the desired application and size of bag 100. In certain embodiments, a single thread-like lace 140 has two ends connected to adjustment device 130. In certain embodiments, lace 140 is two separate laces, each connected to adjustment device 130. In certain embodiments, a single lace 140 can extend from adjustment device 130 such that an end of the lace 140 is coupled to spacing panel 120.

Adjustment device 130, lace 140, spacing panel 120, and back panel 110 can function as the main components of the adjustment system for bag 100. Lace 140 can physically connect adjustment device 130 to spacing panel 120. Lace 140 can act as the drive element in a pulley system. Adjustment device 130 can be used to tighten/shorten and release/lengthen lace 140. By doing so, in certain embodiments, when lace 140 is tightened, an upper edge 125 of spacing panel 120 can be translated toward an upper edge 115 of back panel 110. Because spacing panel 120 is connected to lace 140 and attached to back panel 110, when lace 140 is tightened, force is applied to back panel 110, causing back panel 110 to curve, thereby creating a space 160 between spacing panel 120 and back panel 110 (as shown, for example, in FIG. 10). Similarly, when adjustment device 130 is used to lengthen lace 140, spacing panel 120 can be translated away from an upper edge 115 of back panel 110, thereby decreasing the curve 180 in back panel 110 and therefore the space 160 between spacing panel 120 and back panel 110.

Figure 2:
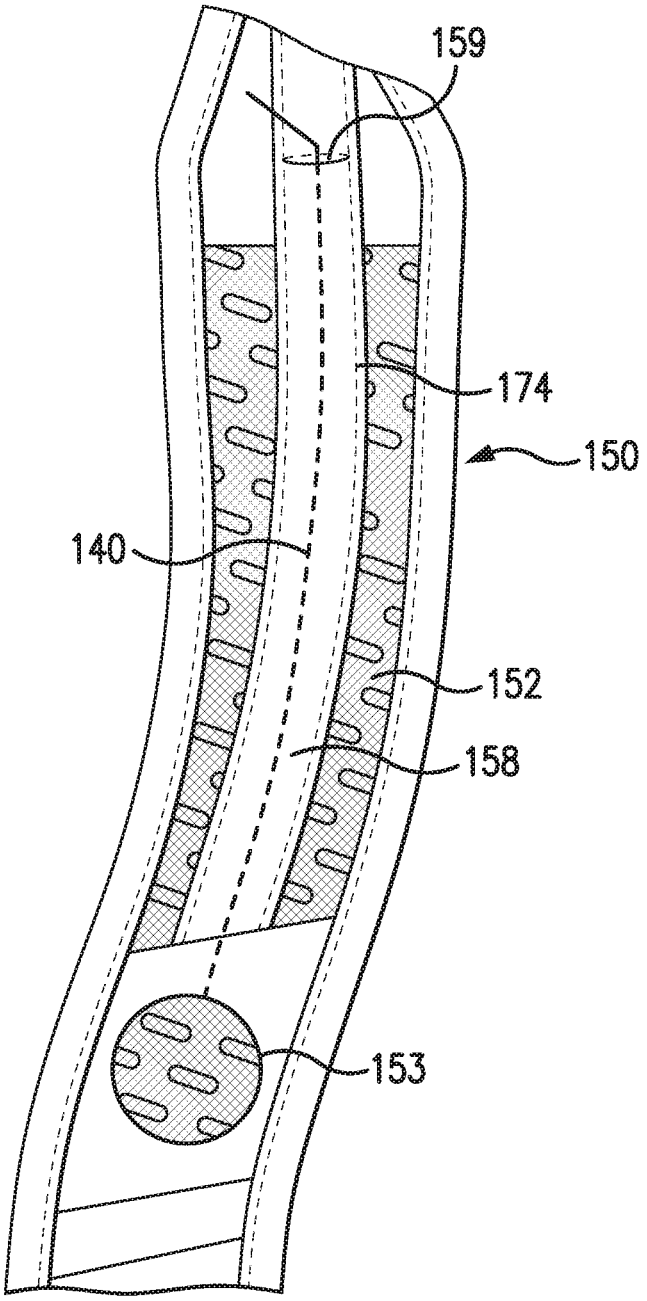
FIG. 2 is a partial view of a shoulder strap of a bag according to an embodiment.

FIG. 2 illustrates shoulder strap 150 according to an embodiment. As shown in FIG. 2, shoulder strap 150 can have an exterior side 152. Shoulder strap 150 can include a cut out 153 where the adjustment device 130 can be located upon assembly. In certain embodiments, webbing 158 can be disposed along a length of shoulder strap 150. Webbing 158 can be attached to exterior side 152 of shoulder strap 150, for example, by stitching 174. Webbing 158 can be any suitable material, for example, canvas, nylon, polyester, leather, etc.

The dashed line in FIG. 2 shows a pathway of lace 140, according to an embodiment. Lace 140 can extend from adjustment device 130 and through webbing 158, i.e., between exterior side 152 of shoulder strap 150 and webbing 158. In this way, webbing 158 can act as a channel or passageway for lace 140. This can prevent snagging of lace 140, for example, on branches while hiking. It can also provide a sleek appearance of bag 100 such that lace 140 is not visible. However, in certain embodiments, lace 140 can be exposed and visible. In certain embodiments, rather than running through webbing 158, lace 140 can run through an interior of shoulder strap 150.

Figure 3:
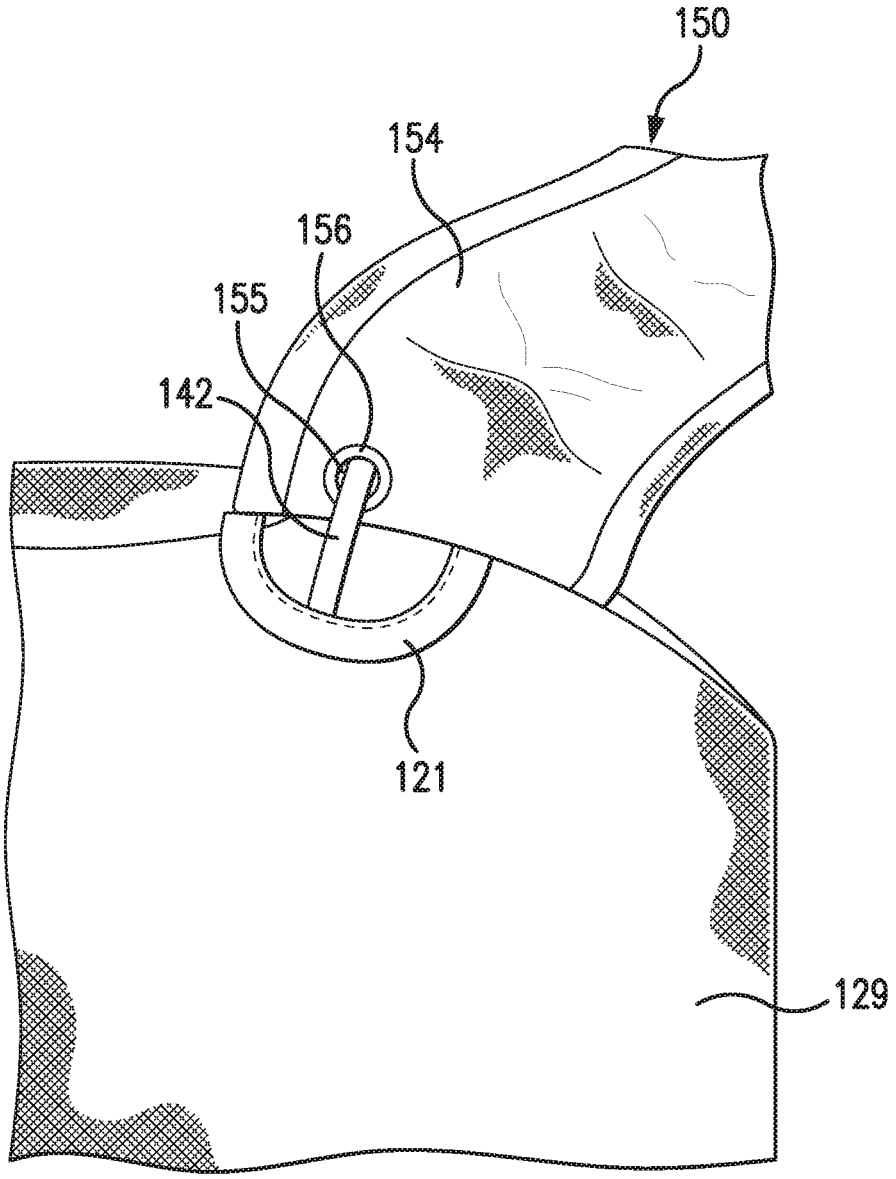
FIG. 3 illustrates an interior side of a shoulder strap according to an embodiment.

FIG. 3 illustrates tubing 142, which can house lace 140, as it extends out of the interior side 154 of shoulder strap 150, according to an embodiment. One or more length(s) of tubing 142 can house all or a portion of lace 140. In certain embodiments, tubing 142 can house lace 140 at least along the length from adjustment device 130 to where lace 140 extends out of the interior side 154 of shoulder strap 150. Tubing 142 can be made from any suitable material, for example, plastic or rubber. Tubing 142 can protect lace 140, for example, from frictional and impact forces, to help maintain the strength and integrity of lace 140. In certain embodiments, tubing 142 can have a low friction interior surface to facilitate the movement of lace 140 within tubing 142. In certain embodiments, there is no tubing around any portion of lace 140.

In certain embodiments, a hole 155 can allow the lace 140 to enter shoulder strap 150 from exterior side 152 and exit interior side 154. In certain embodiments, a reinforcement ring 156 such as a grommet can be located around a circumference of hole 155. Reinforcement ring 156 can be made of, for example, metal or plastic. In certain embodiments, the shape of reinforcement ring 156 can be other than circular. As also shown in FIG. 3, in certain embodiments, binding 121 can be disposed on spacing panel 120 to provide a reinforced passage for lace 140.

In certain embodiments, lace 140 need not pass through interior side 153 of shoulder strap 150. For example, in certain embodiments, lace 140 can exit through an opening 159 in webbing 158 (as shown, for example, in FIG. 2) near where shoulder strap 150 attaches to main body 102 of bag 100. Opening 159 can be located at other points along webbing 158. In certain embodiments, lace 140 can enter exterior side 152 of shoulder strap near adjustment device 130 and exit back through exterior side 152 of shoulder strap near where shoulder strap 150 attaches to main body 102. In certain embodiments, lace 140 can run exposed along a length of exterior side 152 of shoulder strap 150.

Figure 4:
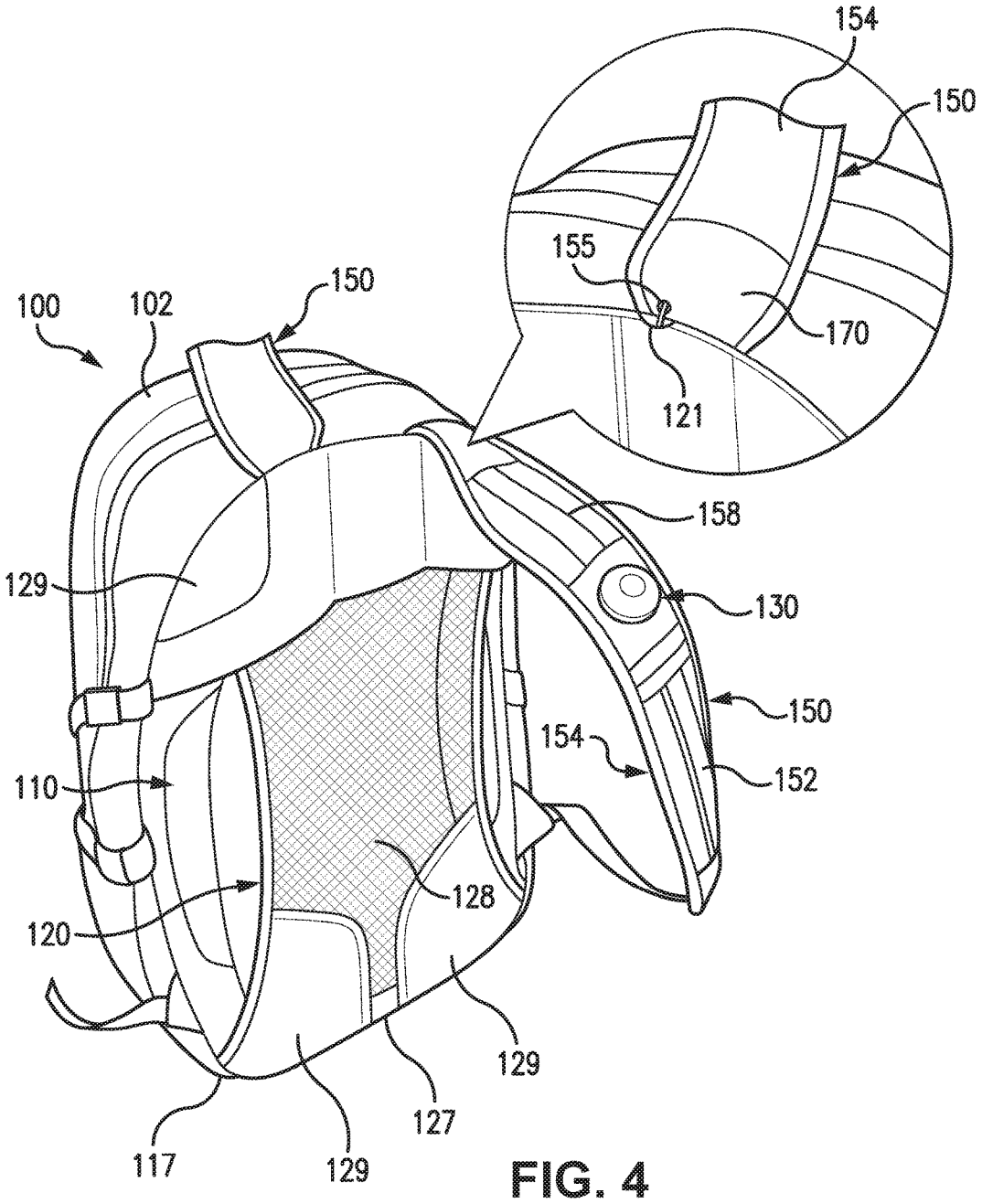
FIG. 4 is a rear perspective view of a bag according to an embodiment, including an enlarged partial view of a bag shoulder strap according to an embodiment.

FIG. 4 illustrates a bag 100 according to an embodiment. As shown in FIG. 4, bag 100 can have main body 102. Main body 102 can have pocket(s) with interior storage area(s), as is common in traditional backpacks. FIG. 4 also illustrates shoulder strap 150 having an exterior side 152, an interior side 154, and webbing 158. In certain embodiments, adjustment device 130 can be disposed on shoulder strap 150.

FIG. 4 also illustrates back panel 110 and spacing panel 120 of bag 100. Back panel 110 can have a lower edge 117 and spacing panel 120 can have a lower edge 127. In certain embodiments, lower edge 127 of spacing panel 120 can be attached to lower edge 117 of back panel 110. Thus, when lace 140 is tightened by adjustment device 130, tension is placed on spacing panel 120. This can pull on lower edge 127 of spacing panel 120 and lower edge 117 of back panel 110, which in turn can result in curving of back panel 110, thereby forming a space between back panel 110 and spacing panel 120.

As further shown in FIG. 4, spacing panel 120 can have mesh portion 128 and one or more sections of padding 129. Mesh portion 128 can allow for additional airflow near the carrier's back. In certain embodiments, other materials, for example, breathable fabrics, can be substituted for mesh portion 128 or used in conjunction therewith for spacing panel 120. Padding 129 can be disposed at various locations of spacing panel 120, for example, near shoulder and/or hip locations of bag 100. This can provide cushioning to the carrier's shoulders and hips, typical points of contact between bag 100 and the carrier while carrying bag 100, improving the comfort of bag 100. Padding 129 can also cover much of the adjustment system (for example, lace 140 and lace supports 112, 122*a*, 122*b*) to hide them from view. In certain embodiments, the adjustment system can be concealed in other ways, for example, by covering it with fabric or incorporating it under an outer layer of back panel 110.

FIG. 4 also shows an underside view of shoulder strap 150 near upper edges 115 and 125 of back panel 110 and spacing panel 120, respectively. In certain embodiments, interior side 154 of shoulder strap 150 can include guide component 170. In certain embodiments, guide component 170 can be made of, for example, molded rubber or plastic. Guide component 170 can provide a semi-rigid structure to facilitate a change in direction of lace 140 as it extends from shoulder strap 150 to spacing panel 120. The semi-rigid nature of guide component 170 can help prevent lace 140 from kinking, which would make retracting lace 140 by adjustment device 130 more difficult. Similarly, as described in more detail below with respect to FIGS. 11 and 12, in certain embodiments, shoulder strap 10 can include a reinforcement panel 176.

Figure 5:
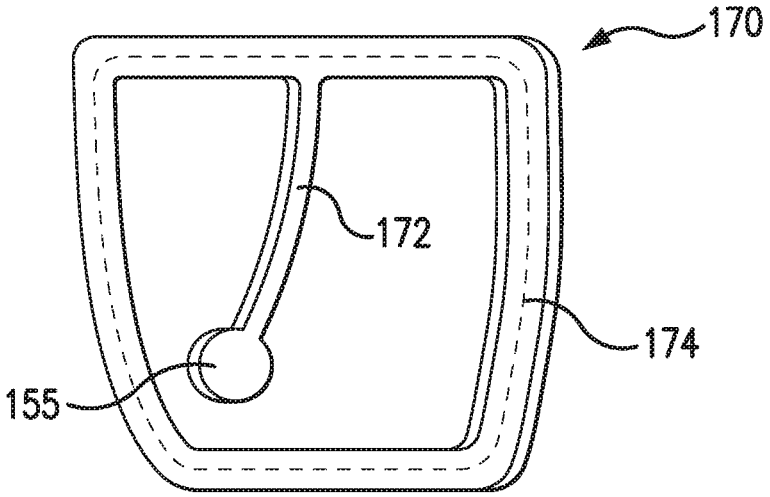
FIG. 5 is a plan view of a guide component according to an embodiment.

FIG. 5 illustrates details of guide component 170 according to an embodiment. In certain embodiments, guide component 170 can include channel 172 which can provide a pathway for lace 140. In certain embodiments, channel 172 can be a groove in a surface of guide component 170. In certain embodiments, channel 172 can be a hollow passageway through an interior of guide component 170. In certain embodiments, guide component 170 can include hole 155, which as discussed with reference to FIG. 3, can include a reinforcement ring 156 in certain embodiments. Hole 155 can allow lace 140 to pass from guide component 170 through interior side 154 of shoulder strap 150. In certain embodiments, guide component 170 can be attached to shoulder strap 150, for example, by stitching 174.

Figure 6:
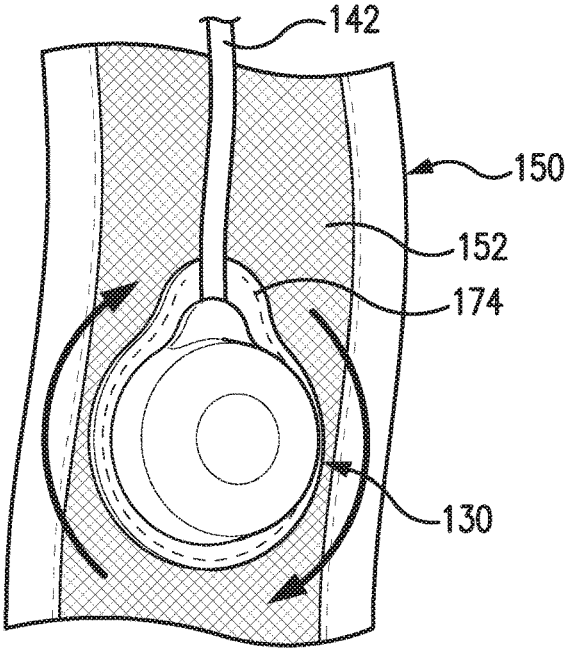
FIG. 6 illustrates tightening a lace by rotating an adjustment device according to an embodiment.
Figure 7:
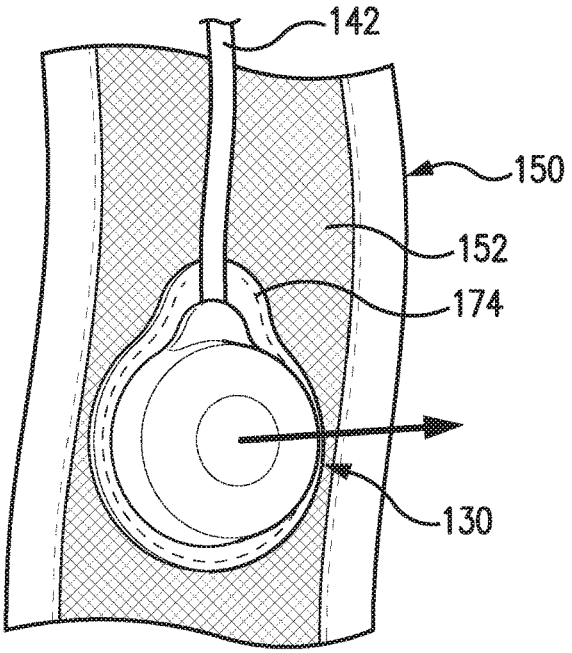
FIG. 7 illustrates releasing tension on a lace by an adjustment device according to an embodiment.

FIGS. 6 and 7 illustrate operation of adjustment device 130 according to embodiments. In certain embodiments, adjustment device 130 can be a dial-type adjustment device for a lace. Other types of dials and/or tension adjustment systems can also be used. By way of example, in certain embodiments, the adjustment device 130 can have a rotatable reel or spool that is configured to receive the lace 140. A knob can rotate the spool to wind the lace about the spool to tighten the lace 140. In certain embodiments, rotating the knob in an unwinding direction can release the spool and allow the lace 140 to unwind. In certain embodiments, the spool can have ratchet teeth disposed on its periphery configured to interact with a pawl for inhibiting rotation of the spool in at least one direction.

Other mechanisms for adjustment device 130 are also contemplated. For example, in certain embodiments, adjustment device 130 can be a pump buckle or a ratcheted buckle. In such an embodiment, manipulation of a lever, for example, of the buckle can tighten or loosen lace 140. For example, lace 140 can have a toothed portion that can be pulled through the buckle by operating a lever.

Figure 8:
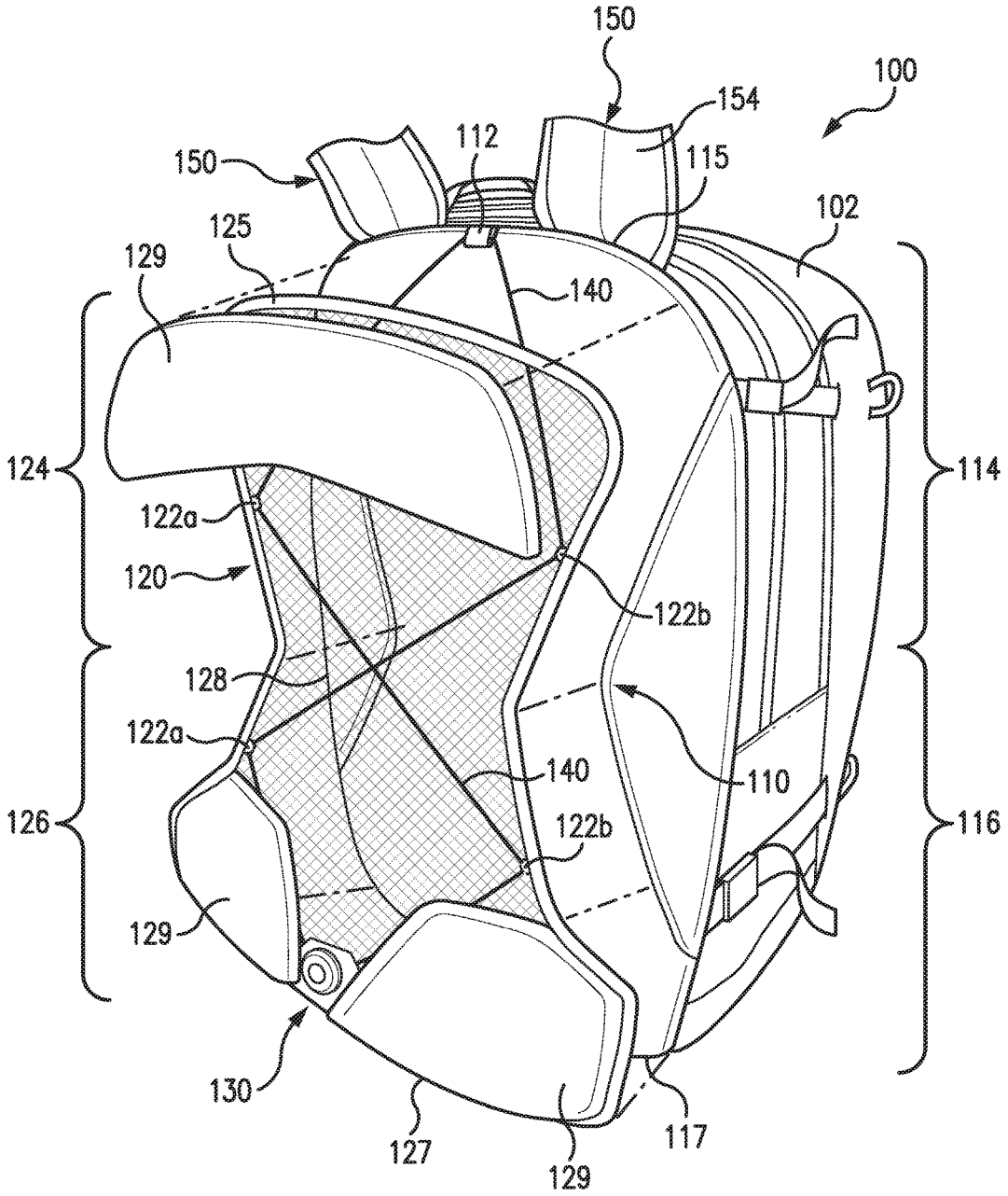
FIG. 8 is a rear perspective view of a bag according to an embodiment.

In certain embodiments, adjustment device 130 can be affixed to shoulder strap 150. For example, adjustment device 130 can be affixed to shoulder strap 150 by stitching 174 or adhesive. Adjustment device 130 can also be located elsewhere on bag 100. For example, as shown in FIG. 8, in certain embodiments, adjustment device 130 can be located on spacing panel 120 or back panel 110. In such an embodiment, the carrier can still operate adjustment device 130 while carrying bag 100. For example, the carrier can reach behind them toward the bottom of bag 100 and manipulate adjustment device 130 with one hand.

FIG. 6 illustrates rotation of adjustment device 130 according to an embodiment. In certain embodiments, by rotating adjustment device 130, lace 140 can be tightened or retracted in an incremental manner. For example, in certain embodiments, by rotating adjustment device 130 in a clockwise direction, lace 140 can be wound about a spool in adjustment device 130. As described in more detail below, this can shorten the operative length of lace 140 and thereby translate spacing panel 120. This, in turn, causes back panel 110 to curve and creates a space between spacing panel 120 and back panel 110. In certain embodiments, rotating adjustment device 130 in a counter-clockwise direction can release lace 140 from the spool, thereby lengthening the operative length of lace 140 and decreasing the space between spacing panel 120 and back panel 110.

FIG. 7 illustrates release of lace 140 by adjustment device 130 according to an embodiment. As shown in FIG. 7, in certain embodiments, lace 140 can be released (i.e., the operative length of lace 140 is lengthened) by pulling on adjustment device 130. For example. Adjustment device 130 can be pulled in a direction away from shoulder strap 150. In certain embodiments, this can quickly loosen lace 140. As lace 140 is lengthened, it can decrease the curve in back panel 110 and therefore decrease the space between spacing panel 120 and back panel 110. In certain embodiments, pushing on adjustment device 130 can release lace 140. In other embodiments, other user manipulation of adjustment device 130 may release lace 140.

FIG. 8 illustrates bag 100 according to an embodiment. In FIG. 8, adjustment device 130 is located near a lower edge 127 of spacing panel 120. In certain embodiments, adjustment device 130 can be located on back panel 110. Lace supports 122*a* and 122*b* can be located along spacing panel 120 at various positions. Lace 140 can run through lace supports 122*a* and 122*b* and through lace support 112 on back panel 110. In certain embodiments, the lace supports can be, for example, loops of fabric attached to back panel 110 and spacing panel 120. In certain embodiments, the lace supports can be plastic or nylon. The lace supports can guide the direction of the lace 140 and provide locations to connect lace 140 with back panel 110 and/or spacing panel 120, which can facilitate distributing force applied by lace 140. In certain embodiments, lace support 112 can be disposed near upper edge 115 of back panel 110. In certain embodiments, lace 140 can extend from lower lace supports 122*a*, 122*b* or directly from adjustment device 130 to lace support 112 on back panel 110. Other lacing patterns are also contemplated. For example, in certain embodiments, the lace can extend directly from the adjustment device 130 to the spacing panel 120.

Features of bag 100 in FIG. 8 can be similar to other embodiments described herein. For example, bag 100 can include main body 102, back panel 110, and spacing panel 120. FIG. 8 also shows shoulder strap 150 having interior side 154. Back panel 110 can have an upper portion 114 and lower portion 116. Spacing panel 120 can also have an upper portion 124 and lower portion 126. In certain embodiments, spacing panel 120 can include mesh portion 128 and one or more sections of padding 129. For example, padding 129 can be located near contact points of a carrier's shoulders and hips with bag 100. In certain embodiments, lower edge 127 of spacing panel 120 can attach to bag 100 at lower edge 117 of back panel 110. In certain embodiments, when adjustment device 130 is manipulated to tighten lace 140, the upper edge 125 of spacing panel 120 can be translated toward upper edge 115 of back panel 110. As in other embodiments, this can form a curve in back panel 110 thereby increasing a space between back panel 110 and spacing panel 120. Air can flow in this space and cool the carrier.

Figure 9:
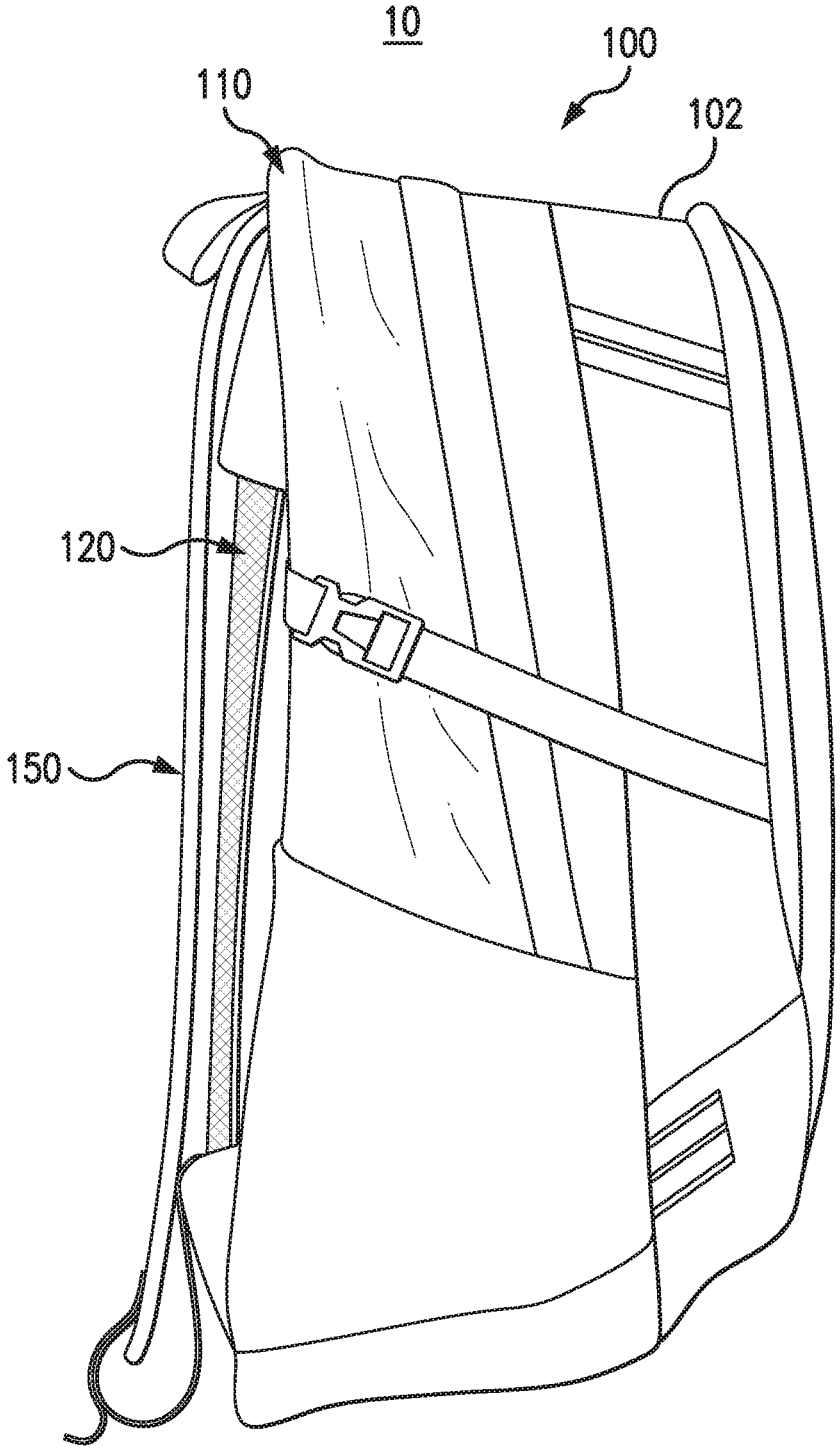
FIG. 9 is a side view of a bag in a first configuration according to an embodiment.

FIG. 9 illustrates bag 100 in a first configuration 10, according to an embodiment. First configuration 10 is generally the state of bag 100 before using adjustment device 130 to tighten lace 140, where lace 140 is at its maximum operative length and back panel 110 is generally flat. As shown in FIG. 9, bag 100 can have main body 102, back panel 110, spacing panel 120, and shoulder strap 150. In certain embodiments of the first configuration 10, the spacing panel 120 can be adjacent to back panel 110. The spacing panel 120 and back panel 110 can be generally parallel to each other. In certain embodiments, spacing panel 120 and back panel 110 can be in contact in first configuration 10 along a majority of a length of spacing panel 120. As shown in FIG. 9, in an embodiment of first configuration 10 there can be little or no space between back panel 110 and spacing panel 120. In certain embodiments, back panel 110 is not curved, for example, when lace 140 is at a maximum operative length.

Figure 10:
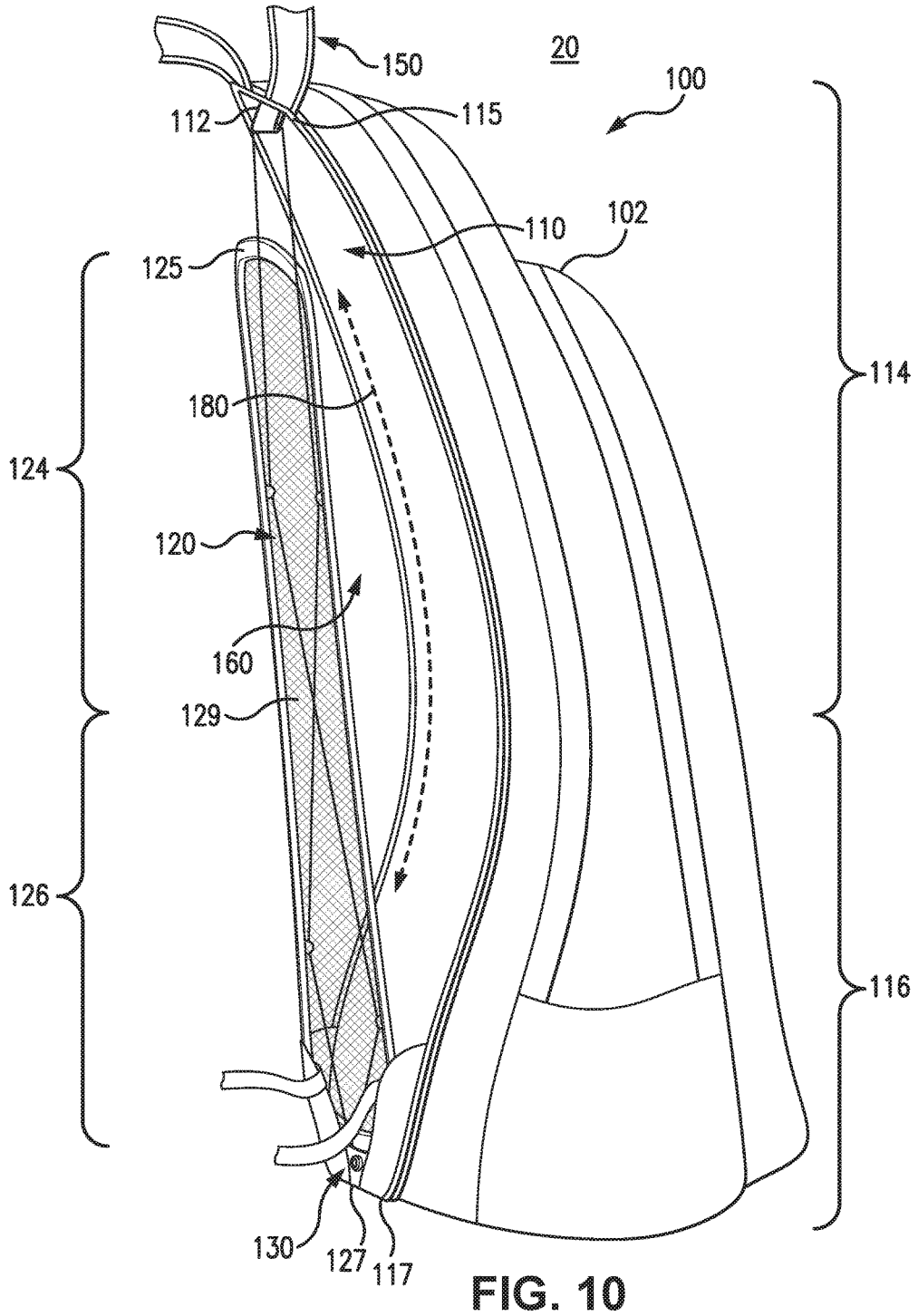
FIG. 10 is a side view of a bag in a second configuration according to an embodiment.

FIG. 10 illustrates bag 100 in a second configuration 20 (with padding 129 not shown) according to an embodiment. Second configuration 20 illustrates bag 100 after tightening lace 140 with adjustment device 130. The distance between upper edge 125 of spacing panel 120 and upper edge 115 of back panel 110 is shorter in second configuration 20 than first configuration 10. The relative degree of proximity depends on how much lace 140 is shortened.

As shown in FIG. 10, bag 100 can have main body 102, back panel 110, and spacing panel 120. Back panel 110 can have an upper portion 114 and a lower portion 116. In certain embodiments, upper portion 114 can be an upper half of back panel 110 and lower portion 116 can be a lower half of back panel 110. Similarly, in certain embodiments, upper portion 124 of spacing panel 120 can be an upper half of spacing panel 120 and lower portion 126 of spacing panel 120 can be a lower half of spacing panel 120. In certain embodiments, lower edge 127 of spacing panel 120 can be attached to lower portion 116 of back panel 110. In certain embodiments, lower edge 127 of spacing panel 120 can be attached to lower edge 117 of back panel 110.

As shown in FIG. 10, by tightening lace 140 and thereby shortening the operative length of lace 140, the upper edge 125 of spacing panel 120 is translated toward the upper edge 115 of back panel 110. This, in turn, causes a curve 180 to be formed in back panel 110. This creates a space 160 between spacing panel 120 and back panel 110. As lace 140 is tightened, curve 180 becomes more defined and space 160 between spacing panel 120 and back panel 110 may therefore become larger. Thus, the degree or radius of curvature of curve 180, and therefore the size of space 160, may depend on how much lace 140 is tightened by adjustment device 130.

Figure 11:
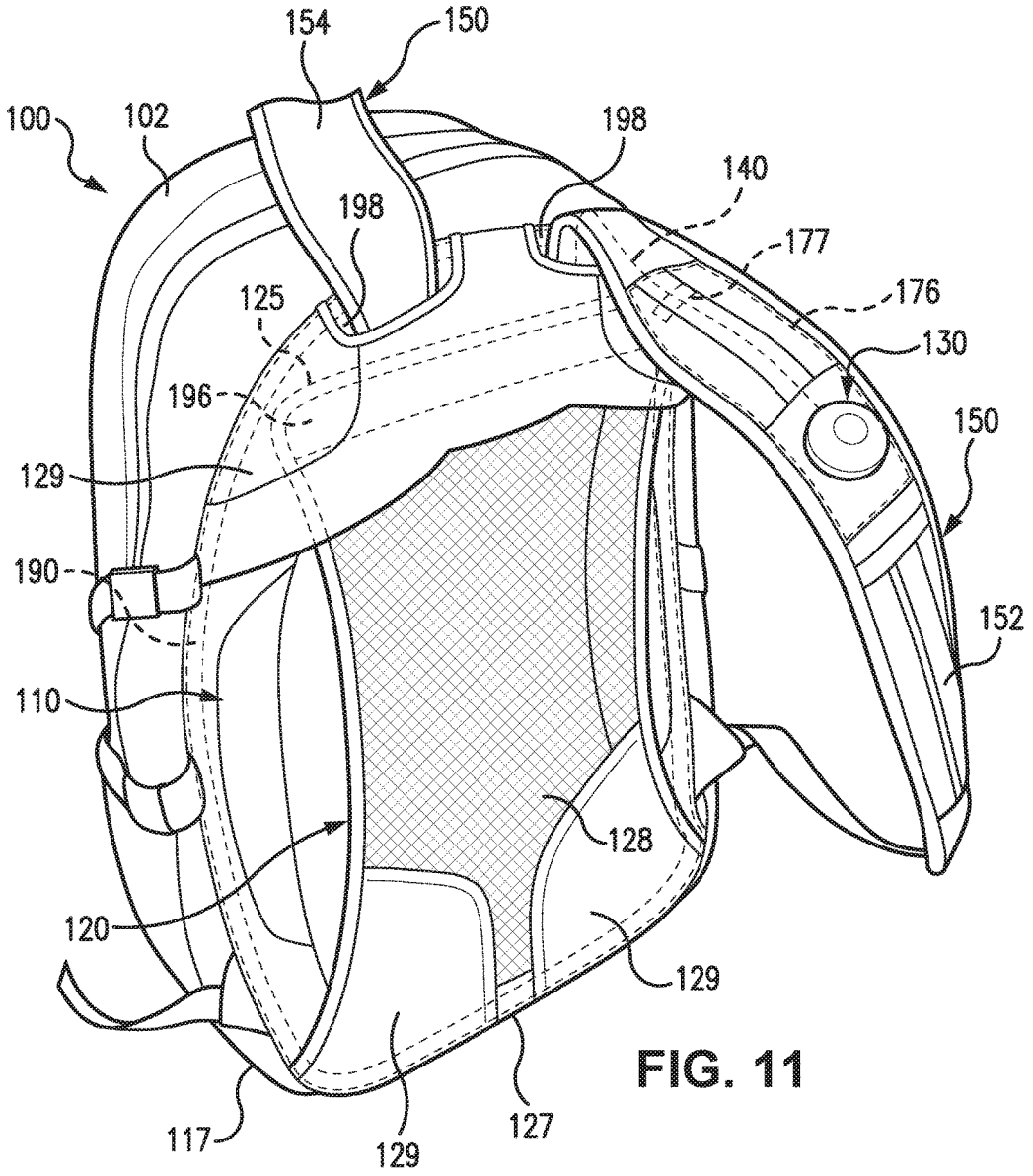
FIG. 11 is a rear perspective view of a bag according to an embodiment.

FIG. 11 illustrates bag 100 according to an embodiment. Features of bag 100 in FIG. 11 can be similar to other embodiments described herein and can operate in a similar manner as described herein. For example, bag 100 can include main body 102, back panel 110, and spacing panel 120. FIG. 11 also shows shoulder strap 150 having interior side 154. In certain embodiments, spacing panel 120 can include mesh portion 128 and one or more sections of padding 129, for example, near lower edge 127 and upper edge 125.

FIG. 11 also shows a phantom view of padding 129 near upper portions 114, 124 of back panel 110 and spacing panel 120. In certain embodiments, padding 129 can have one or more cutouts 198 through which shoulder straps 150 can pass through. In certain embodiments, lace 140 can extend from adjustment device 130 and through shoulder strap 150. In certain embodiments, lace 140 can pass through a hole 177 in a reinforcement panel 176, which is described in more detail below. In certain embodiments, lace 140 can then exit shoulder strap 150 through hole 155 of interior side 154, for example, as shown and described with respect to FIG. 3. In certain embodiments, lace 140 can connect to spacing panel 120, for example, at a lace support as described herein. When lace 130 is tightened, tension can be placed on spacing panel 120 that draws upper edge 125 closer to upper edge 115 of back panel 110, thereby forming a curve in back panel 110 and creating a space between back panel 110 and spacing panel 120.

In certain embodiments, spacing panel 120 can include reinforcement member 196. In certain embodiments, reinforcement member 196 can be disposed at or near upper edge 125 of spacing panel 120. Reinforcement member 196 can be disposed across all or a portion of the width of spacing panel 120. Reinforcement member 196 can improve the distribution of tension across the width of spacing panel 120 when adjustment device 130 is used to tighten lace 140. By more evenly distributing the tension across the width of spacing panel 120, the curve in back panel 110 can more easily be formed.

Reinforcement member 196 can be made of polypropylene, polyethylene, other plastics, fiberglass, metal, fabric, or other suitable materials. In certain embodiments, reinforcement member 196 can be a flat plastic strip extending across the width of spacing panel 120. In certain embodiments, reinforcement member 196 can be a rod extending along upper edge 125 of spacing panel 120.

Figure 12:
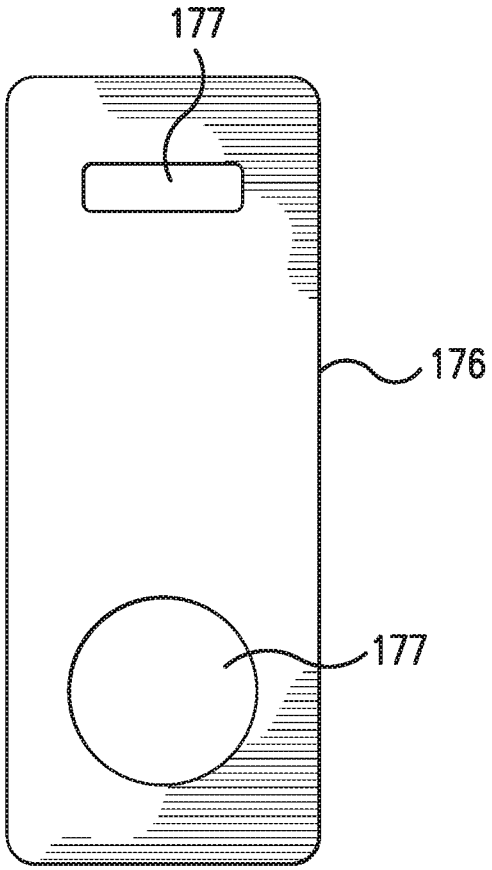
FIG. 12 illustrates a reinforcement panel for a shoulder strap according to an embodiment.

As shown in FIG. 11 and separately in FIG. 12, in certain embodiments, shoulder strap 150 can include reinforcement panel 176. In certain embodiments, reinforcement panel can be disposed inside of shoulder strap 150, for example, between exterior side 152 and interior side 154. Reinforcement panel 176 can provide additional structure to shoulder strap 150 to limit twisting of the shoulder strap 150 under tension from lace 140. Reinforcement panel 176 can be made from any suitable material, for example, but not limited to polypropylene, polyethylene, or composite materials.

In certain embodiments, reinforcement panel 176 can include one or more cutouts 177, for example, a cutout 177 for adjustment device 130 and a cutout 177 so that lace 140 can pass through reinforcement panel 176. In certain embodiments, reinforcement panel 176 can include a groove or channel similar to channel 172 in FIG. 5, for example between cutouts 177, so that lace 140 can be disposed within the channel.

Figure 13:
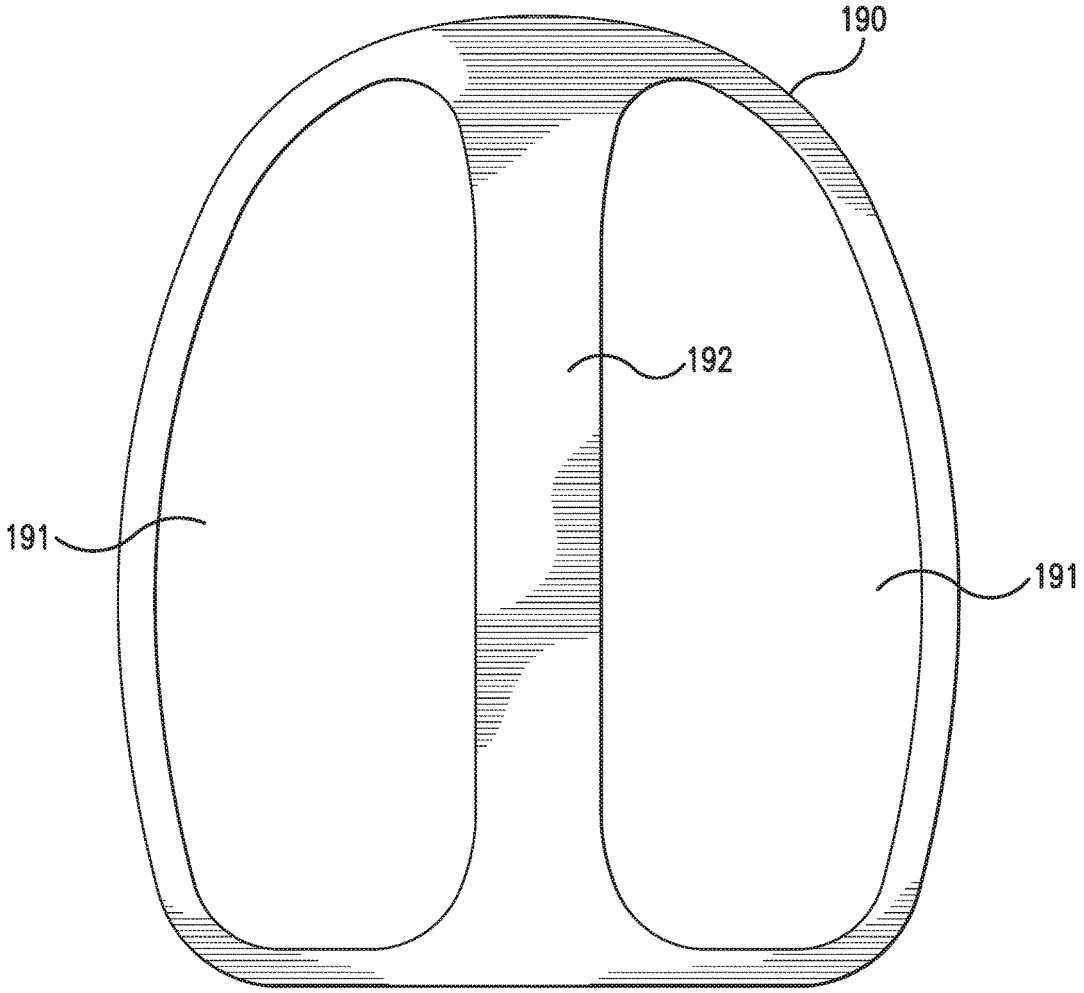
FIG. 13 illustrates a frame for a back panel of a backpack according to an embodiment.

As also shown in FIG. 11 and separately in FIG. 13, in certain embodiments, back panel 110 can include frame 190. In certain embodiments, frame 190 can be disposed inside of back panel 110 so that it is not visible from the exterior of backpack 100. Frame 190 can provide additional structure to back panel 110 in order to facilitate forming a smooth curve. Frame 190 can help distribute force imparted to back panel 110 when spacing panel 120 is placed under tension by tightening the lace 140. Frame 190 can be made from any suitable material, for example, but not limited to polypropylene, polyethylene, other plastics, or composite materials.

In certain embodiments, frame 190 can be a solid, flexible board, for example, in the shape of back panel 110, extending from upper edge 115 to lower edge 117 and across the width of back panel 110. In certain embodiments, for example as shown in FIG. 13, frame 190 can have one or more cutouts 191 and a spine 192 extending along a length of frame 190. Spine 192 can provide additional rigidity along a central portion of back panel 110. Frame 190 can have other shapes, numbers, and patterns of cutouts 191. In certain embodiments, frame 190 can have one large cutout 191 without spine 192, such that frame 190 is an outline of the shape of back panel 110. In certain embodiments, frame 190 can only be spine 192, that is, a portion of substantially rigid material in back panel 110. In certain embodiments, frame 192 can be spine 192 with an additional portion of material at the top and/or bottom of the spine 192, forming an "I" or "T" shape.

It is to be appreciated that the Detailed Description section, and not the Brief Summary and Abstract sections, is intended to be used to interpret the claims. The Summary and Abstract sections may set forth one or more but not all exemplary embodiments of adjustable bags and backpacks as contemplated by the inventors, and thus, are not intended to limit the present invention and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A bag comprising:

a back panel having an edge portion;

a spacing panel having a fixed edge attached to the back panel and a free edge;

an adjustment device;

a lace connecting the adjustment device and the spacing panel; and a shoulder strap, wherein the lace passes through an exterior side of the shoulder strap and an interior side of the shoulder strap, wherein the adjustment device is configured to retract the lace, thereby translating the spacing panel toward the edge portion of the back panel, thereby increasing a space between the spacing panel and the back panel.

2. The bag of claim 1, wherein the space between the spacing panel and the back panel is smaller in a first configuration than in a second configuration, and wherein the back panel of the bag is curved in the second configuration.

3. The bag of claim 2, further comprising a rigid frame coupled with the back panel and configured to flex in a curved manner as the bag transitions from the first configuration to the second configuration.

4. The bag of claim 1, wherein the spacing panel further comprises a first lace support, and wherein the lace extends through the first lace support.

5. The bag of claim 4, wherein the back panel further comprises a second lace support, wherein the lace extends through, in order, the first lace support and the second lace support.

6. The bag of claim 5, wherein the second lace support is disposed at the edge portion of the back panel, and wherein the first lace support is disposed along the free edge of the spacing panel.

7. The bag of claim 6, wherein the adjustment device is configured to move the first lace support closer to the second lace support.

8. The bag of claim 1, wherein the lace passes through a hole in the interior side of the shoulder strap, and wherein a reinforcement ring is disposed around a circumference of the hole.

9. The backpack of claim 1, wherein the shoulder strap further comprises a reinforcement panel having a cutout through which the lace passes, wherein the reinforcement panel is configured to resist twisting of the shoulder strap.

10. The bag of claim 1, wherein a lower edge of the spacing panel is attached to a lower edge of the back panel.

11. The bag of claim 1, wherein the adjustment device comprises an adjustment dial.

12. The bag of claim 11, wherein rotation of the adjustment dial tightens the lace, thereby translating the spacing panel.

13. The bag of claim 1, wherein the adjustment device is disposed on a shoulder strap of the bag.

14. The bag of claim 1, wherein the lace comprises ultra-high-molecular-weight polyethylene.

15. The bag of claim 1, wherein the spacing panel comprises mesh and includes a reinforcement member disposed across a width of an upper portion of the spacing panel.

16. The bag of claim 1, further comprising a tube surrounding a portion of the lace.

17. A backpack comprising:

an adjustment dial disposed on the backpack;

a lace extending from the adjustment dial;

a back panel comprising an upper portion having an upper edge and a lower portion having a lower edge; and a spacing panel comprising an upper portion having an upper edge, a lower portion having a lower edge, and a first lace support, wherein the lower portion of the spacing panel is attached to the lower portion of the back panel, wherein the lace extends through the first lace support, and wherein the back panel further comprises a second lace support, and wherein the lace extends through, in order, the first lace support and the second lace support.

18. The backpack of claim 17, wherein the second lace support is disposed at the upper edge of the back panel, and wherein the first lace support is disposed at an edge of the spacing panel.

19. The backpack of claim 18, wherein rotation of the adjustment dial retracts the lace, thereby moving the first lace support toward the second lace support such that a space between the spacing panel and the back panel is smaller in a first configuration than in a second configuration, and wherein the back panel of the bag is curved in the second configuration.

20. The backpack of claim 17, wherein the lace passes through a hole in an interior side of a shoulder strap and a reinforcement ring is disposed around a circumference of the hole.

21. The backpack of claim 17, wherein the backpack further comprises a shoulder strap having a reinforcement panel, wherein the reinforcement panel is configured to resist twisting of the shoulder strap.

22. A method of adjusting the fit of a backpack, comprising:

rotating an adjustment dial, wherein rotating the adjustment dial tightens a lace extending from the adjustment dial, thereby forming a curve in a back panel of the backpack and increasing an airflow space between a spacing panel connected to the lace and the back panel of the backpack, wherein the lace extending from the adjustment dial passes through an exterior side of a shoulder strap of the backpack and an interior side of the shoulder strap.

23. The method of claim 22, wherein tightening the lace translates the spacing panel and curves the back panel of the backpack.

24. The method of claim 22, further comprising pulling the adjustment dial, thereby releasing a portion of the lace from the adjustment dial, thereby decreasing the airflow space between the spacing panel and the back panel.

25. The method of claim 22, wherein the adjustment dial is rotated while the backpack is carried on a back of a user by at least one shoulder strap.

* * * * *